US006421989B1

(12) United States Patent
Leson

(10) Patent No.: US 6,421,989 B1
(45) Date of Patent: Jul. 23, 2002

(54) SADDLE PAD

(76) Inventor: Donn Leson, 2883 Williams Hwy., Grants Pass, OR (US) 97527

( * ) Notice: Subject to any disclaimer, the term of this patent is extended or adjusted under 35 U.S.C. 154(b) by 0 days.

(21) Appl. No.: 09/816,904

(22) Filed: Mar. 26, 2001

(51) Int. Cl.[7] ..... B68C 1/12
(52) U.S. Cl. ..... 54/66
(58) Field of Search ..... 54/65, 66, 79.4

(56) References Cited

U.S. PATENT DOCUMENTS 184,975 A * 12/1876 McCormick ..... 54/66
530,864 A * 12/1894 Torrey ..... 54/66
1,006,960 A * 10/1911 Leibe ..... 54/66
1,080,901 A * 12/1913 Eilers ..... 54/65
5,058,367 A * 10/1991 Evertson ..... 54/66

* cited by examiner

*Primary Examiner*—Robert P. Swiatek
(74) *Attorney, Agent, or Firm*—Harrison & Egbert

(57) ABSTRACT

A saddle pad having a first panel with a plurality of channels extending transverse to a longitudinal axis of the first panel, a second panel having a plurality of channels extending transverse to a longitudinal axis of the second panel, and a connector strip secured on one side to the first panel and on an opposite side to the second panel. Each of the first and second panels includes a first layer of a thermoformed polymeric material and a second layer of a leather-like material affixed to the first layer. The thermoformed polymeric material is ethylene vinyl acetate. The channels open to respective edges of the first and second panel and to the connector strip.

20 Claims, 3 Drawing Sheets

SADDLE PAD

BACKGROUND OF THE INVENTION

1. Field of the Invention

The present invention relates to equine tack. More particularly, the present invention relates to a saddle pad which is to be placed on the back of a horse between the back of the horse and the bottom of the saddle placed thereon.

2. Description of Related Art

Commonly, saddle pads are placed between the horse and saddle to protect the horse from irritation caused by the weight of the saddle and rider and to help prevent slippage of the saddle from its proper position over the withers and back of the horse. Historically, blankets and other woven products were used between the horse and the saddle. More recently, cushioning substances such as polyurethane foams have been employed to create a pad between the horse and the saddle.

These saddle blankets and foam saddle pads, while providing some protection to the horse, do not, however, give much relief from the constant rubbing and pounding the saddle and rider inflict on horses generally, and especially horses involved in rigorous training regimens. Horses subjected to daily training are prone to develop soreness over the withers, shoulders and back. This soreness is attributable to the tendency of the saddle to dig into the horse's withers and back, abrasions caused by the rubbing of the saddle, bruises administered by the bouncing weight of the saddle and rider, and/or structural defects in bones, ligaments and tendons produced by sharp impact forces generated by the saddle and rider.

Additionally, woven blankets and most saddle pads are absorbent in nature, soaking up the sweat of the horse. This feature diminishes the horse's ability to cool itself through the evaporation of sweat. Further, saddle blankets and pads have a tendency to splay out from the horse at their periphery rather than conforming to the contour of the horse, decreasing the surface area contacted by the blankets or pads. Still further, the blankets and pads tend to become compressed after periods of use. The more compressed the blankets and pads become, the less effective they are in preventing injury to the animal.

Where wool blankets are used as a saddle pad, the fresh raw wool performs the saddle pad function reasonably well. Natural oils in the wool resist moisture saturation. Even though wet with perspiration wiped from the horse's back, the wool fibers sustain a large degree of resilience and openness to ventilation. However, as a natural animal hair, wool also harbors and even sustains bacteria, fungus and mildew. The usual sanitation practice of washing the blanket with soap and water also removes the protective natural oils from the fiber, thereby reducing the primary advantages of wool. Once these natural oils are removed from the wool fiber, water is absorbed and the wet resilience is lost.

Numerous synthetic materials have also been used for saddle pads and blankets including fabrics woven from polyester and other similar materials. Also, elastomer foams such as polyester, polyurethane and polyurethane foams have been used. Although each of these materials have particular strengths or advantages relative to natural raw wool, none have a combination of properties comparable to wool. For example, a closed cell foam provides excellent resilience but almost no moisture wicking or ventilation capacity. Woven synthetic materials have little resistance or moisture wettability. Consequently, synthetic fiber has but small moisture wicking properties.

It is an object of the present invention to provide a synthetic material saddle pad having a high degree of air ventilation and wettability for moisture drainage.

It is another object of the present invention to provide a saddle pad that does not absorb the horse's perspiration.

It is another object of the present invention to provide a highly flexible saddle pad that easily conforms to the contours of the body of the horse and the shape of the saddle.

It is another object of the present invention to provide a saddle pad that is slip resistive between the horse's back and the saddle so as to better secure the relative position of the saddle on the horse, especially in steep terrain riding.

It is another object of the present invention to provide a saddle pad of synthetic material that does not sustain bacteria or fungus.

It is still a further object of the present invention to provide a saddle pad having superior cushioning ability and a lightweight structure.

It is still a further object of the present invention to provide a saddle pad which keeps the pad from binding across the withers and shoulder of the horse and which allows more freedom of movement.

It is still a further object of the present invention to provide a saddle pad which distributes the rider's weight where it is most easily carried by the horse.

These and other objects and advantages of the present invention will become apparent from a reading of the attached specification and appended claims.

BRIEF SUMMARY OF THE INVENTION

The present invention is a saddle pad that comprises a first panel having a plurality of channels extending transverse to a longitudinal axis of the first panel, a second panel having a plurality of channels extending transverse to a longitudinal axis of the second panel, and a connector strip secured on one side to the first panel and on an opposite side to the second panel. The first and second panels are comprised of a thermoformed polymeric material.

In the present invention, the first and second panels have an identical shape. Each of the first and second panels includes a first layer of the thermoformed polymeric material and a second layer of a leather-like material affixed to a surface of the first layer opposite the plurality of channels. A third layer of a leather-like material is affixed to a surface of the second layer opposite the first layer. The third layer extends along an edge of the second layer and extends inwardly therefrom for less than a width of the second layer.

The plurality of channels formed on each of the first and second panels are corrugations molded in the thermoformed polymeric material. The plurality of channels have one end opening toward an outer edge of the respective panels and an opposite end opening toward the connector strip.

In the present invention, each of the first and second panels has an area of thickness greater than the remainder of the first and second panels. This area of greater thickness extends inwardly from the connector strip for less than the entire width of the respective panels. The area of greater thickness has a curved shape on a side of the area of greater thickness opposite the connector strip.

In the present invention, the thermoformed polymeric material is ethylene vinyl acetate. The connector strip is formed of a nylon webbing. The second layer is formed of either leather or a synthetic leather. The connector strip has a thickness that is less than a thickness of the first and second panels.

DETAILED DESCRIPTION OF THE INVENTION

Figure 1:
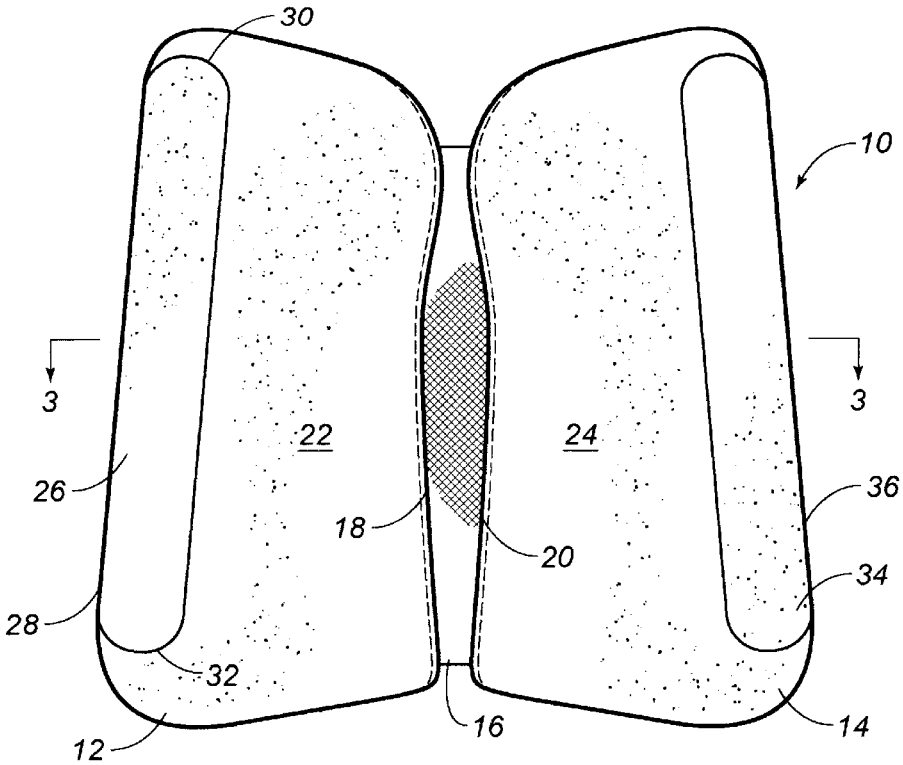
FIG. 1 is a plan view of the saddle pad in accordance with the teachings of the present invention.

Referring to FIG. 1, there is shown at 10 the saddle pad in accordance with the teachings of the present invention. The saddle pad 10 includes a first panel 12 and a second panel 14. A connector strip 16 is secured to an inner edge 18 of the first panel 12 and to an inner edge 20 of the second panel 14. The first panel 12 has a top layer 22 of a leather or leather-like material. Similarly, the second panel 14 has a top layer 24 formed of a leather or a leather-like material. For example, the material used for the top layers 22 and 24 of the respective panels 12 and 14 can be a micro fiber synthetic suede material. The connector strip 16 is secured to the layer forming the top layers 22 and 24. A wear leather strip 26 is secured to the first panel 12 along outer edge 28. The wear leather strip 26 has curved ends 30 and 32 and extends inwardly from the outer edge 28 a distance for less than the width of the first panel 22. Similarly, the second panel 24 has a wear leather strip 34 extending inwardly from outer edge 36 of the second panel 24. The wear leather strip 34 has an identical configuration to the wear leather strip 26. The wear leather strips 26 and 34 are affixed to the top layers 22 and 24, respectively, of panels 12 and 14. The wear leather strips 26 and 34 provide protection against wear caused by the cinch, the girth of the horse and the stirrup leather.

Each of the panels 12 and 14 is of an identical shape. The panels 12 and 14 are suitably contoured to fit the back of the horse. As a result, the contouring of the respective panels 12 and 14 keeps the saddle pad 10 from binding across the withers and shoulder of the horse and allows more freedom of movement.

The connector strip 16 is formed of a nylon webbing material. The connector strip 16 has a thickness which is less than the thickness of the panels 12 and 14. When placed on a horse, the connector strip 16 will reside beneath the center of the saddle and reside upon the backbone of the horse. The inner edges 18 and 20 of respective panels 12 and 14 are suitably contoured so as to further conform to the shape of the backbone of the horse.

Figure 2:
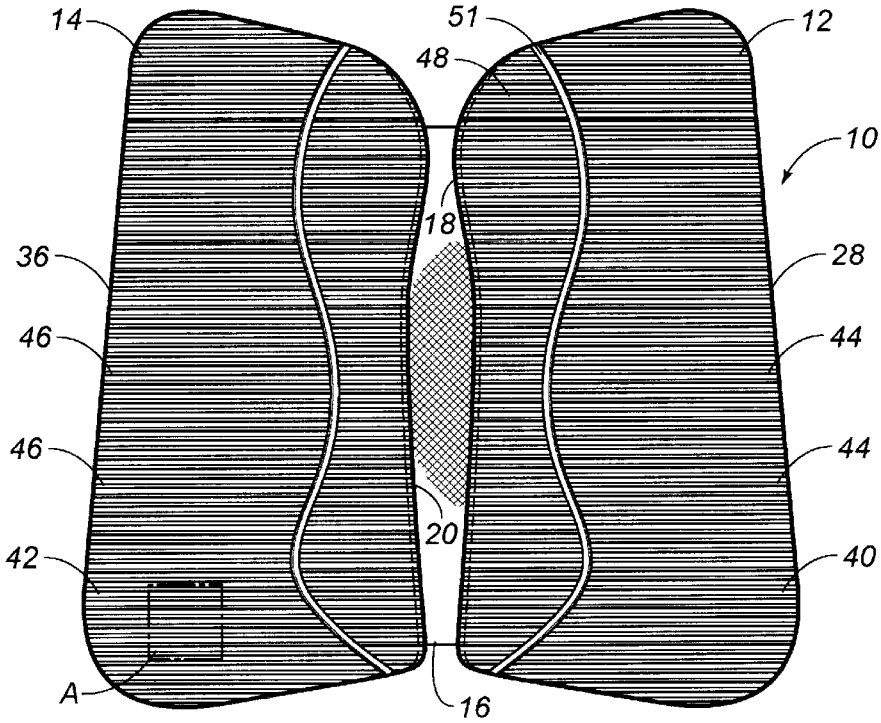
FIG. 2 is a bottom view of the saddle pad of the present invention.
Figure 5:
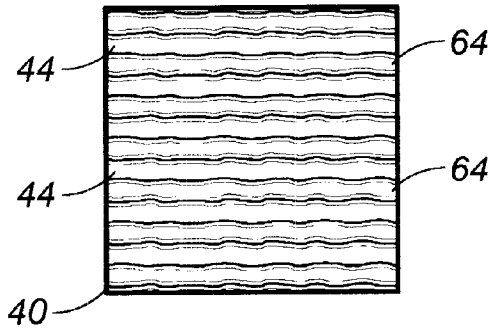
FIG. 5 is an expanded view of boxed area "A" of FIG. 2.

FIG. 2 shows the underside of the saddle pad 10. This underside of the saddle pad 10 will be juxtaposed against the body of the horse when in actual use. Importantly, the underside of the saddle pad 10 is formed of respective bottom layers 40 and 42. Bottoms layers 40 and 42 are each formed of a thermoformed polymeric material. In particular, this thermoformed polymeric material is ethylene vinyl acetate. As can be seen, a plurality of channels 44 are formed in the layer 40 of panel 12. Similarly, channels 46 are formed in the bottom layer 42 of panel 14. Each of the channels 44 and 46 extends transverse to the longitudinal axis of the respective panels 12 and 14. The particular shape of the channels 44 and 46 is illustrated in FIG. 5 relative to boxed area "A". Importantly, the channels 44 have one end opening to the outer edge 28 of the first panel 12. Channels 44 also open along the inner edge 18 adjacent to the connector strip 16. Similarly, the second panel 14 has its channels 46 opening, on one side, to the outer edge 36 and at the opposite end toward the inner edge 20 adjacent to the connector strip 16.

When placed upon the body of the horse, the channels 44 and 46 will extend vertically. As a result, this unique system allows air to circulate and vent through the channels so as to evaporate moisture and to dissipate heat from the body of the horse. As a result, these channeled panels 12 and 14 will help to keep the horse's back cooler and more comfortable.

Since the bottom layers 40 and 42 are formed of ethylene vinyl acetate, they will have a tendency to conform relative to the forces placed upon them. As a result, when a saddle does not fit perfectly to the back of the horse, the bottom layers 40 and 42 of the saddle pad 10 will tend to conform and deform so as to establish a better fit between the saddle and the back of the horse. The memory of the ethylene vinyl acetate will tend to return to its original position when the forces of the saddle are no longer applied to it.

In FIG. 2, it can be seen that the bottom layer 40 has an area 48 of greater thickness than the remainder 50 of the bottom layer 40. This area 48 of greater thickness extends inwardly from the inner edge 18 for less than the entire width of the first panel 12. The area 48 of greater thickness has a side 51 which is curved in an undulating fashion from one end of the first panel 12 to the opposite end of the first panel 12. The second panel 14 has a similar area 52 of greater thickness extending, in the same manner, as the area 48 of greater thickness of panel 12. These areas 48 and 52 of greater thickness provide for more protection of the horse in the area under the bar of the saddle. As such, it provides better cushioning and shock absorbance in those areas most likely to affect the horse. The unique design of the saddle pad 10 will distribute the rider's weight where it is most easily carried by the horse. It will eliminate bulk under the upper leg and allow better contact and positioning of the lower leg. The combination of the channels 44 and 46, along with the ethylene vinyl acetate material, provide an easy care, close-contact and non-slip surface. The ethylene vinyl acetate used for the bottom layers 40 and 42 has superior cushioning ability and is very lightweight. The use of the synthetic material avoids the requirement of laundering and hanging time to dry. The saddle pad 10 of the present invention simply requires a quick hosing off, and shake drying.

Figure 3:
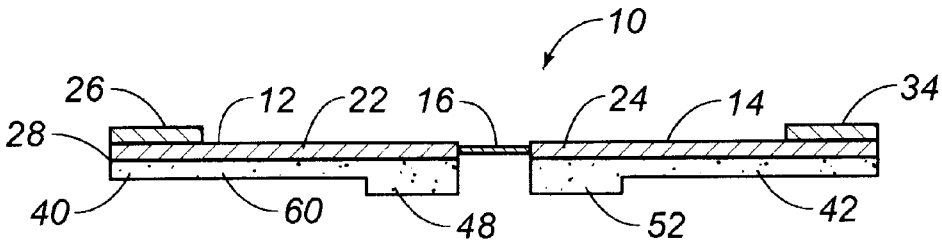
FIG. 3 is a cross-sectional view taken across lines 3—3 of FIG. 1.

FIG. 3 is a cross-sectional view of the saddle pad 10 in accordance with the teachings of the present invention. As can be seen, the saddle pad 10 includes a first panel 12 and a second panel 14 with a connecting strip 16 affixed therebetween. The connecting strip 16 has a thickness less than that of the first panel 12 or the second panel 14. The first panel 12 is formed of the first (or bottom) layer 40 of the thermoformed polymeric material. The second (or top) layer 22 is affixed in surface-to-surface contact with a top surface of the first layer 40. The third layer (or wear leather strip) 26 is affixed to the surface of the second layer 22 opposite the first layer 40. The third layer 26 is affixed along the outer edge 28 of the first panel 12 and extends inwardly therefrom for less than the width of the second layer 22. It can be seen that the area of greater thickness 48 extends further outwardly from the bottom surface 60 of the first layer 40. The channels 44 will extend through the first layer 40 so as to open, at one end, adjacent to the outer edge 28 and, at the other end, adjacent to the connecting strip 16.

The second panel 14 has an identical configuration to that of the first panel 12. In particular, the second panel 14 includes the first layer 42 of the thermoformed polymeric material, the second layer 24 of the leather-like material and the third layer 34 of the wear leather.

Figure 4:
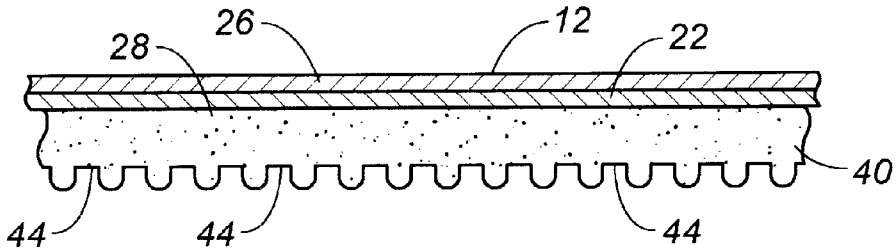
FIG. 4 is a partial side view of the saddle pad of the present invention showing the arrangements of layers and corrugations thereon.

FIG. 4 is a partial side view of expanded size of the side 28 of the first panel 12. As can be seen, the first layer 40 has a plurality of channels 44 formed therein. These channels 44 are formed between adjacent corrugations of the thermoformed polymeric material 40. The channels 44 will extend from the edge 28 through the thermoformed polymeric material layer 40 toward the connecting strip 16. The second layer 22 is affixed to the top surface of the polymeric layer 40. The third layer 26 is affixed to a top surface of the second layer 22 opposite the thermoformed polymeric material layer 40.

FIG. 5 is a greatly magnified view of the boxed area "A" of FIG. 2. As can be seen, the thermoformed polymeric layer 40 has channels 44 extending between adjacent pairs of corrugations 64. The channels are not smooth channels but are of an irregular shape. This irregular shape will help to distribute the weight of the saddle pad more evenly over the body of the horse. The channels 44 are suitably shaped so that air will flow therethrough and vent outwardly through either the top of the bottom of the channel when the saddle pad 10 is placed on a horse.

Figure 6:
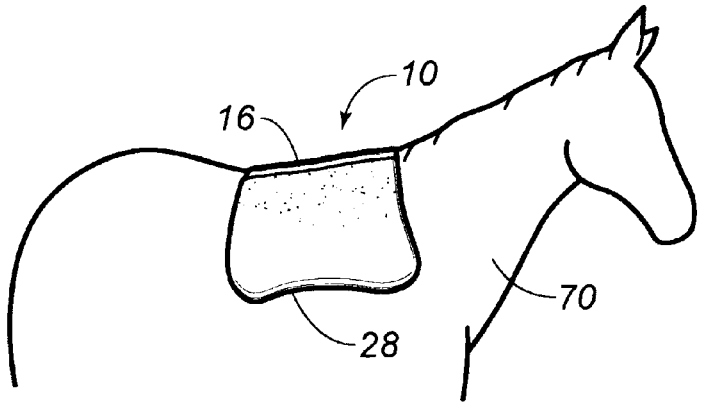
FIG. 6 is a side view showing the placement of the saddle pad of the present invention on a horse.

FIG. 6 shows the placement of the saddle pad 10 on a horse 70. The saddle pad 10 has its outer edge 28 suitably shaped so as to conform properly to the body of the horse so as to keep the pad 10 from binding across the withers and shoulder of the horse and for allowing more freedom of movement by the horse. The connecting strip 16 is located as placed adjacent to the backbone of the horse 70.

Figure 7:
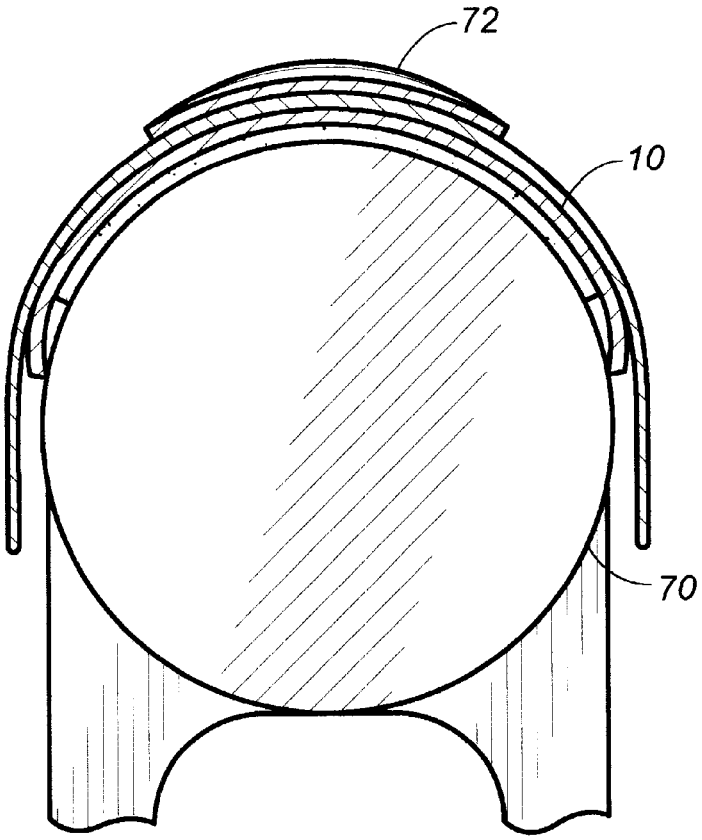
FIG. 7 is a cross-sectional view showing the placement of the saddle pad of the present invention in conjunction with a saddle onto the body of a horse.

FIG. 7 shows the placement of the saddle pad 10 between the body of the horse 70 and the saddle 72.

The foregoing disclosure and description of the invention is illustrative and explanatory thereof. Various changes in the details of the illustrated constructions can be made within the scope of the appended claims without departing from the true spirit of the invention. The present invention should only be limited by the following claims and their legal equivalents.

I claim:

1. A saddle pad comprising:

a first panel having a plurality of channels extending transverse to a longitudinal axis of said first panel;

a second panel having a plurality of channels extending transverse to a longitudinal axis of said second panel; and a connector strip secured on one side to said first panel and on an opposite side to said second panel, said first and second panels being of a thermoformed polymeric material.

2. The saddle pad of claim 1, said first and second panels having an identical shape.

3. The saddle pad of claim 1, each of said first and second panels further comprising:

a first layer of said thermoformed polymeric material, said plurality of channels being formed on a surface of said first layer; and a second layer of a leather-like material affixed to an opposite surface of said first layer.

4. The saddle pad of claim 3, each of said first and second panels further comprising:

a third layer of a leather-like material affixed to a surface of said second layer opposite said first layer.

5. The saddle pad of claim 4, said third layer extending along an edge of said second layer and extending inwardly therefrom for less than a width of said second layer.

6. The saddle pad of claim 1, said plurality of channels of each of said first and second panels being corrugations molded in said thermoformed polymeric material, said plurality of channels having one end opening toward an outer edge of the respective panels and an opposite end opening to said connector strip.

7. The saddle pad of claim 1, said first panel having an area of greater thickness than a thickness of a remainder of said first panel, said area of greater thickness extending inwardly from said connector strip for less than an entire width of said first panel, said second panel having an area of greater thickness than a thickness of a remainder of said second panel, said area of greater thickness of said second panel extending inwardly from said connector strip for less than an entire width of said second panel.

8. The saddle pad of claim 7, the areas of greater thickness having a curved shape on a side opposite said connector strip.

9. The saddle pad of claim 1, said thermoformed polymeric material being ethylene vinyl acetate, said connector strip being a nylon webbing.

10. The saddle pad of claim 1, said connector strip having a thickness less than a thickness of either of said first and second panels.

11. A saddle pad comprising:

a first layer of a thermoformed polymeric material, said first layer having a plurality of channels formed on a surface thereof, said plurality of channels extending transverse to a longitudinal axis of said first layer; and a second layer of a material different than said thermoformed polymeric material of said first layer, said second layer affixed to a surface of said first layer opposite said plurality of channels.

12. The saddle pad of claim 11, further comprising:

a third layer of a leather-like material affixed to a surface of said second layer opposite said first layer.

13. The saddle pad of claim 12, said third layer extending along an edge of said second layer and extending inwardly therefrom for less than a width of said second layer.

14. The saddle pad of claim 11, said first and second layers being formed on a first panel and a second panel, said first panel being secured to a connector strip, said second panel being secured to a connector strip.

15. The saddle pad of claim 14, said plurality of channels each having one end opening adjacent said connector strip.

16. The saddle pad of claim 14, said first layer of said first panel having an area of greater thickness than a thickness of a remainder of said first panel, said area of greater thickness extending inwardly from said connector strip for less than an entire width of said first panel, said first layer of said second panel having an area of greater thickness than a thickness of a remainder of said second panel, said area of greater thickness of said first layer of said second panel extending inwardly from said connector strip for less than an entire width of said second panel.

17. The saddle pad of claim 16, said areas of greater thickness having a curved shape on a side opposite said connector strip.

18. The saddle pad of claim 14, said connector strip having a nylon webbing with a thickness less than a thickness of said first layer, said connector strip being secured to said second layer.

19. The saddle pad of claim 14, said first panel and said second panel having identical shapes.

20. The saddle pad of claim 11, said thermoformed polymeric material of said first layer being ethylene vinyl acetate, said material of said second layer selected from the group consisting of leather and synthetic leather.

* * * * *